US005853222A

United States Patent [19]

Roslund, Jr. et al.

[11] Patent Number: 5,853,222

[45] Date of Patent: Dec. 29, 1998

[54] HEIGHT-ADJUSTABLE CHAIR BACK

[75] Inventors: Richard N. Roslund, Jr., Jenison; Larry A. Wilkerson, Comstock, both of Mich.

[73] Assignee: Haworth, Inc., Holland, Mich.

[21] Appl. No.: 870,953

[22] Filed: Jun. 6, 1997

[51] Int. Cl.[6] ..... B60N 2/02

[52] U.S. Cl. ..... 297/353; 248/297.31

[58] Field of Search ..... 297/353, 411.36; 248/222.11, 295.11, 297.31

[56] References Cited

U.S. PATENT DOCUMENTS

| | | | |
|---|---|---|---|
| 3,295,888 | 1/1967 | Poland | 297/298 |
| 3,802,658 | 4/1974 | Binding | 248/352 |
| 4,012,158 | 3/1977 | Harper | 403/107 |
| 4,036,525 | 7/1977 | Howk | 297/353 |
| 4,043,592 | 8/1977 | Fries | 297/291 |
| 4,099,774 | 7/1978 | Sandham | 297/298 |
| 4,221,430 | 9/1980 | Frobose | 297/353 |
| 4,384,742 | 5/1983 | Wisniewski | 297/353 |
| 4,451,084 | 5/1984 | Seeley | 297/353 |
| 4,616,877 | 10/1986 | Slaats et al. | 297/353 |
| 4,639,039 | 1/1987 | Donovan | 297/353 |
| 4,660,885 | 4/1987 | Suhr et al. | 297/353 |
| 5,044,666 | 9/1991 | Griesemer | 248/297.31 X |
| 5,368,365 | 11/1994 | Feldberg | 297/411.36 |
| 5,582,460 | 12/1996 | Schultz | 297/353 |
| 5,586,809 | 12/1996 | Szmadzinski | 297/353 |
| 5,620,233 | 4/1997 | Corwin | 297/353 X |
| 5,725,278 | 3/1998 | Verbeek | 297/353 |

*Primary Examiner*—Peter R. Brown
*Attorney, Agent, or Firm*—Flynn, Thiel, Boutell & Tanis, P.C.

[57] ABSTRACT

A height-adjustment mechanism is connected between a back assembly of a chair and a rigid upright supported on a seat assembly for selectively adjusting the height of the back assembly relative to the seat assembly. The height-adjustment mechanism is formed as a self-contained cartridge which releasably snaps into a downward opening compartment of the back assembly and does not require the use of separate independent fasteners. The height-adjustment mechanism is formed of a minimum number of parts, namely a plastic housing, a spring plate and an actuator pivotally connected to the housing. The height-adjustment mechanism includes a catch or projection formed on the spring plate which projects into one of a plurality of vertically spaced apertures formed in the upright. While the catch is slidable upwardly along the upright when raising the back assembly, the actuator disengages the catch from the upright to allow downward movement of the back assembly.

20 Claims, 7 Drawing Sheets

HEIGHT-ADJUSTABLE CHAIR BACK

FIELD OF THE INVENTION

The invention relates to an office chair and, more particularly, to an office chair having a height-adjustable back.

BACKGROUND OF THE INVENTION

Office chairs typically include a seat assembly which is mounted to a chair base, and a back assembly which projects upwardly from a rear edge area of the seat to support the back of a user. To make the chair more comfortable, the seat assembly is typically tiltable forwardly and rearwardly relative to the chair base, and in many chairs, the back assembly also is tiltable rearwardly relative to the seat assembly.

To further accommodate the different characteristics of users, it is also known to provide chairs where the back is height-adjustable. Such chairs typically include an upwardly extending rigid upright which is connected to the seat. The back is thereby connected to the upright by a height-adjustment mechanism so that the height of the back relative to the seat can be adjusted to a selected elevation.

Many height-adjustment mechanisms, however, are relatively complex in that they use a number of separate component parts, and are mounted to the upright and back by fasteners or the like which increases the number of component parts and makes it more difficult to mount the height-adjustment mechanism in position.

Examples of height-adjustment mechanisms are disclosed in U.S. Pat. Nos. 4,384,742, 4,639,039, 5,582,460 and 5,586,809.

In view of the foregoing, it is an object of the invention to provide an improved height-adjustment mechanism for a chair back which is formed as a relatively compact cartridge that is mountable to the upright and chair back without the use of independent fasteners so as to overcome disadvantages in known mechanisms as discussed above.

Accordingly, the invention relates to a height-adjustment mechanism for selectively adjusting the height of a chair back relative to a seat thereof. The height-adjustment mechanism is formed as a self-contained cartridge which releasably snaps into a downward opening compartment of the chair back and does not require the use of separate independent fasteners.

The height-adjustment mechanism preferably is formed of a minimum number of parts, namely a plastic housing, a spring plate and an actuator pivotally connected to the housing. The housing defines a vertical slot in which a rigid upright of the seat is received, and the back thereby is mounted to the seat by sliding the upright upwardly into the slot formed in the height-adjustment mechanism.

The height-adjustment mechanism is engagable with a selected one of a plurality of apertures to support the back at a selected one of a plurality of vertically spaced positions. In particular, the height-adjustment mechanism includes a ratchet-like catch or projection formed on the spring plate which projects into a selected one of the apertures. The spring plate includes a cantilevered spring leg on which the catch is formed so as to be normally biased into engagement with the apertures and support the back thereon. The catch, however, includes an inclined camming surface which generally faces upwardly and slides upwardly along the upright in a ratchet-like manner. Thus, the spring leg permits movement of the catch into and out of the apertures such that the catch readily permits upward sliding of the back while preventing downward movement thereof.

To permit the back to be moved downwardly, an actuator for the height-adjustment mechanism is also provided. The actuator comprises a lever arm which is connected to the spring leg and is manually actuated to lift the catch out of the apertures. Thus, the spring leg maintains the height-adjustment mechanism in engagement with the upright while the actuator disengages the height-adjustment mechanism. Besides supporting the catch, however, the spring leg also serves the additional function of acting against the actuator to automatically bias the actuator to the non-actuated position.

Other objects and purposes of the invention, and variations thereof, will be apparent upon reading the following specification and inspecting the accompanying drawings.

Figure 1:
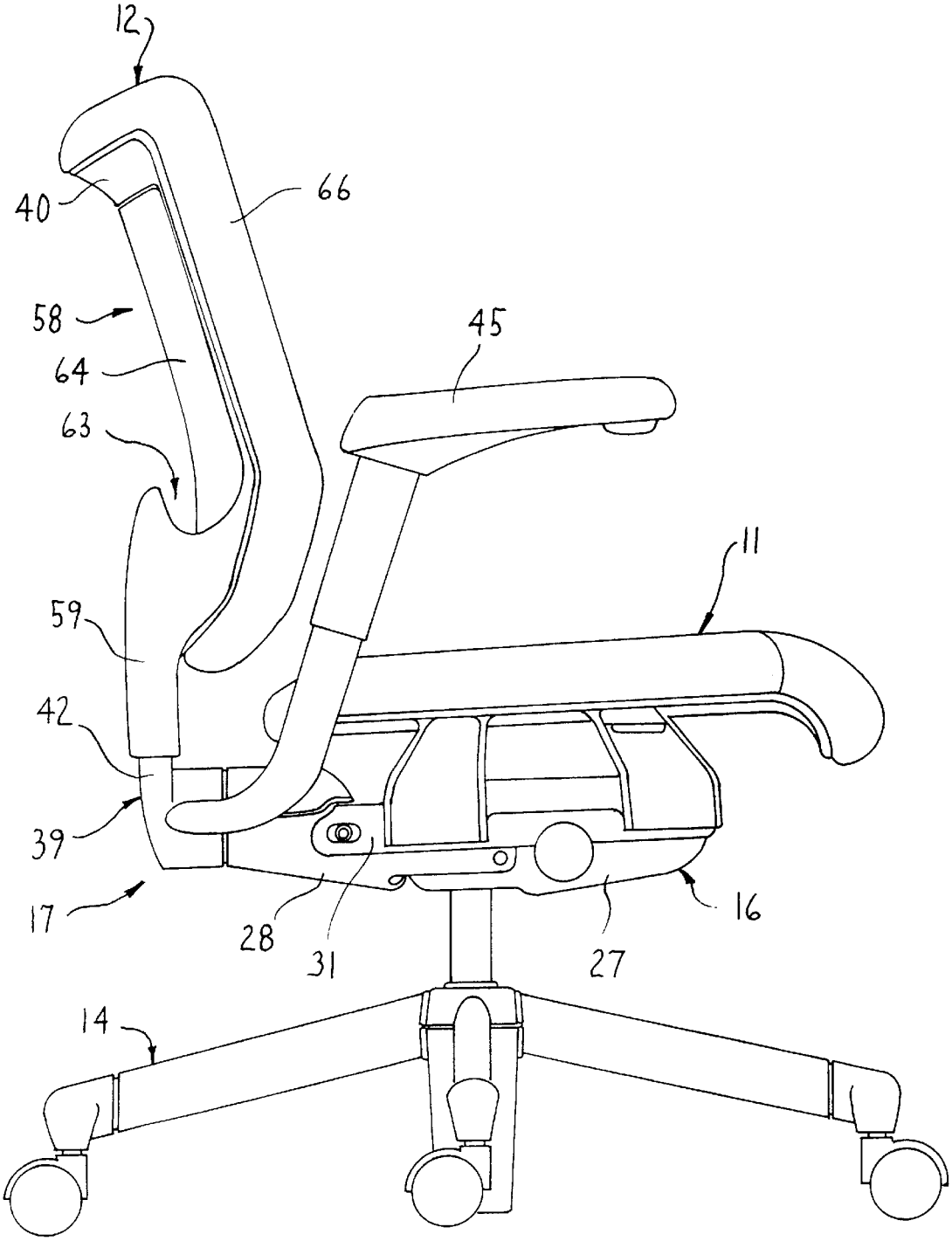
FIG. 1 is a side elevational view of an office chair.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
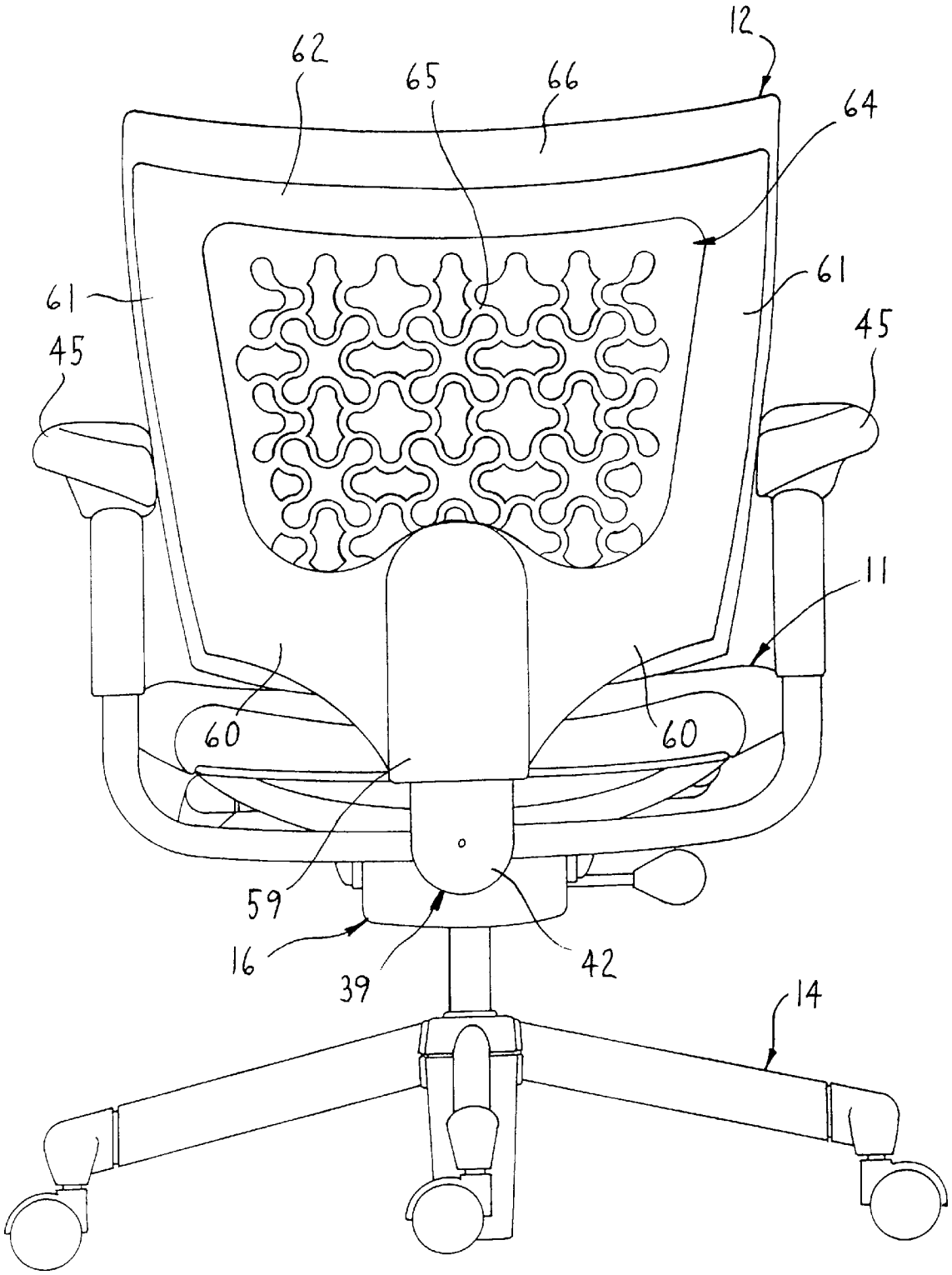
FIG. 2 is a rear elevational view of the office chair.
Figure 3:
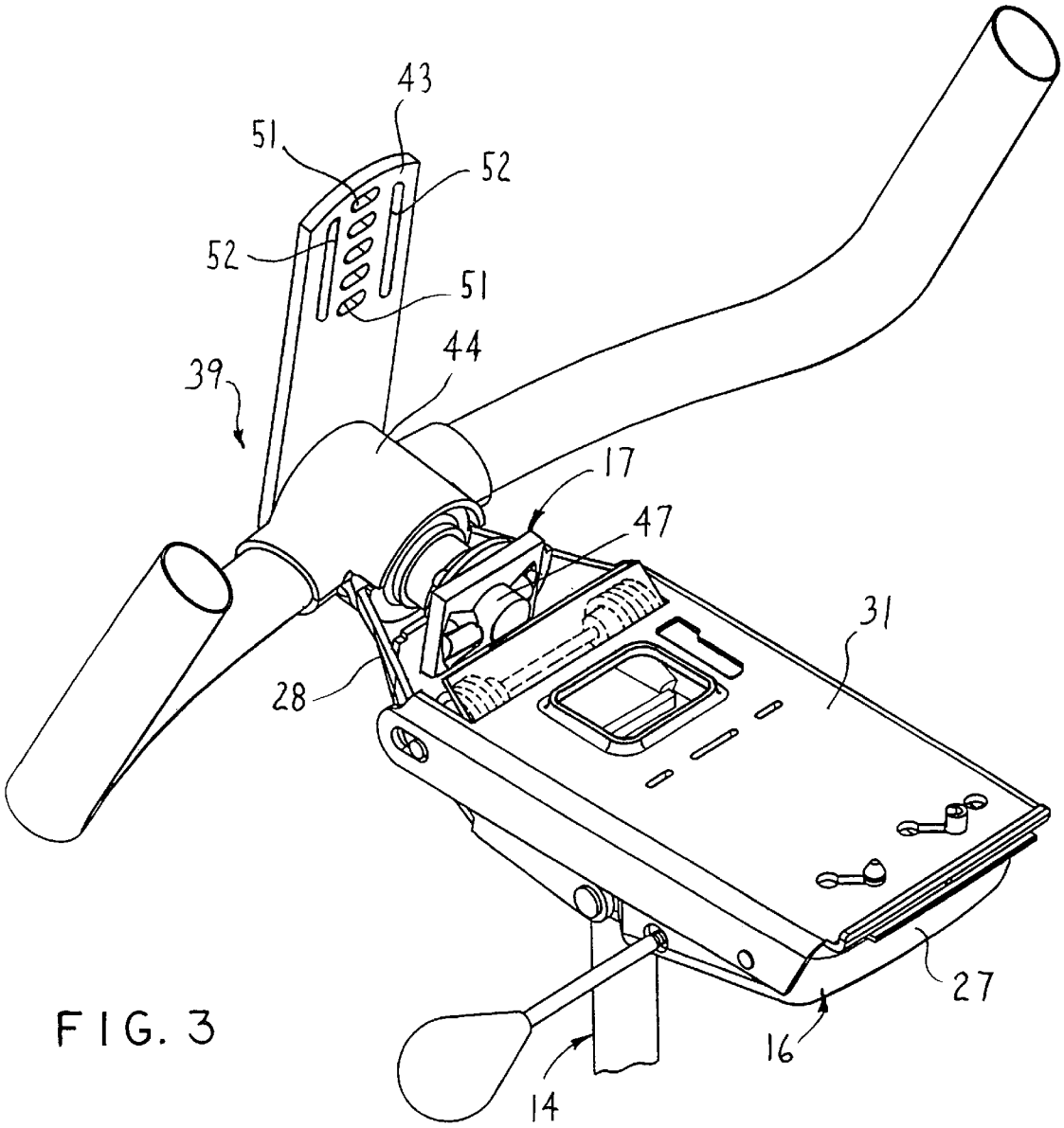
FIG. 3 a partial perspective view illustrating a tilt control mechanism for the chair and an upwardly extending upright connected to the tilt control mechanism.

Referring to FIGS. 1–3, the invention relates to an office-type chair 10 which includes a seat assembly 11 and back assembly 12 that are pivotally supported on a chair base or pedestal 14. To increase the comfort of a user, the seat assembly 11 is tiltable forwardly and rearwardly by a tilt control mechanism 16 while the back assembly 12 thereof is tiltable laterally from side to side, i.e. in the leftward and rightward directions by a back torsion mechanism 17. To further increase the comfort of the user, the back assembly 12 includes a height-adjustment mechanism 18 (FIG. 5) for adjusting the height thereof relative to the seat assembly 11.

Generally with respect to the main components of the chair 10, the base 14 is adapted to be supported on a floor and the seat assembly 11 is mounted to the base 14 by the tilt control mechanism 16. The tilt control mechanism 16 thereby permits rearward tilting of the seat assembly 11 relative to the base 14. The back assembly 12 is connected to the seat assembly 11 by the back torsion mechanism 17, and further includes the height-adjustment mechanism 18 which is formed as a self-contained unit and permits adjustment of the back height.

Generally with respect to the tilt control mechanism 16, the tilt control mechanism 16 includes a control housing 27 which is rigidly secured to the base 14. To support the back assembly 12 thereon, the tilt control mechanism 16 further includes a back support member 28 which is hinged to the control housing 27, and a top plate 31 which has a front edge section pivotally secured to the front of the control housing 27 and a rear edge section slidably secured to the back support member 28. While the control housing 27 remains stationary, the top plate 31 and back support member 28 thereby are joined one with the other so as to pivot downwardly together during rearward tilting of the chair 10. The tilt control mechanism 16 is disclosed in U.S. patent application Ser. No. 08/846,618, entitled TILT CONTROL FOR CHAIR, filed on Apr. 30, 1997 (Atty Ref: Haworth Case 217). The disclosure of this latter application, in its entirety, is incorporated herein by reference.

The back assembly 12 is connected to the back support member 28 by the back torsion mechanism 17 (FIG. 3). The back torsion mechanism 17 is mounted within the rearward end of the back support member 28 and is connected to a lower end of the back assembly 12 as discussed in detail hereinafter. The back torsion mechanism 17 and its connection to the tilt control mechanism 16 is disclosed in U.S. patent application Ser. No. 08/846,614, entitled CHAIR BACK WITH SIDE TORSIONAL MOVEMENT, filed on Apr. 30, 1997 (Atty. Ref.: Haworth Case 216). The disclosure of this latter application, in its entirety, is incorporated herein by reference.

More particularly with respect to the back assembly 12 and the height-adjustment mechanism 18, the back assembly 12 (FIGS. 1–3 and 5) comprises a connecting hub 39 which defines the lower end thereof, and a back frame 40 which is movably connected to the connecting hub 39 by the height-adjusting mechanism 18 as described hereinafter in detail. Generally, with respect to the connecting hub 39, the connecting hub 39 includes an outer cover 42, a vertical rigid upright 43 which is enclosed within the outer cover 42 and supports the back frame 40 thereon, and an arm assembly 44 which is connected to the upright 43 to support a pair of chair arms 45 thereon.

In particular, the upright 43 (FIGS. 3–5) is formed from a rigid metal plate that has an aperture 46 formed through the lower end thereof. To rigidly connect the upright 43 to the tilt control mechanism 16, a horizontally elongate pivot shaft 47 (FIG. 3) of the back torsion mechanism 17 is welded into the aperture 46 and pivotally connected to the back support member 28.

The upper end of the upright 43 includes a plurality and preferably five vertically spaced apart apertures 51 which extend at least partially through the upright 43 and define various heights at which the back frame 40 can be supported. The upper end of the upright 43 further includes a pair of vertically elongate slots 52 which are disposed on the opposite sides of the vertical row of apertures 51.

As seen in FIGS. 1 and 2, while the upright 43 projects upwardly and is adapted to be connected to the back frame 40, the outer cover 42 encloses the portion of the upright 43 located below the back frame 40. To connect the cover 42 to the upright 43, the lower end of the upright 43 includes a set screw hole 49 extending therethrough.

Figure 4:
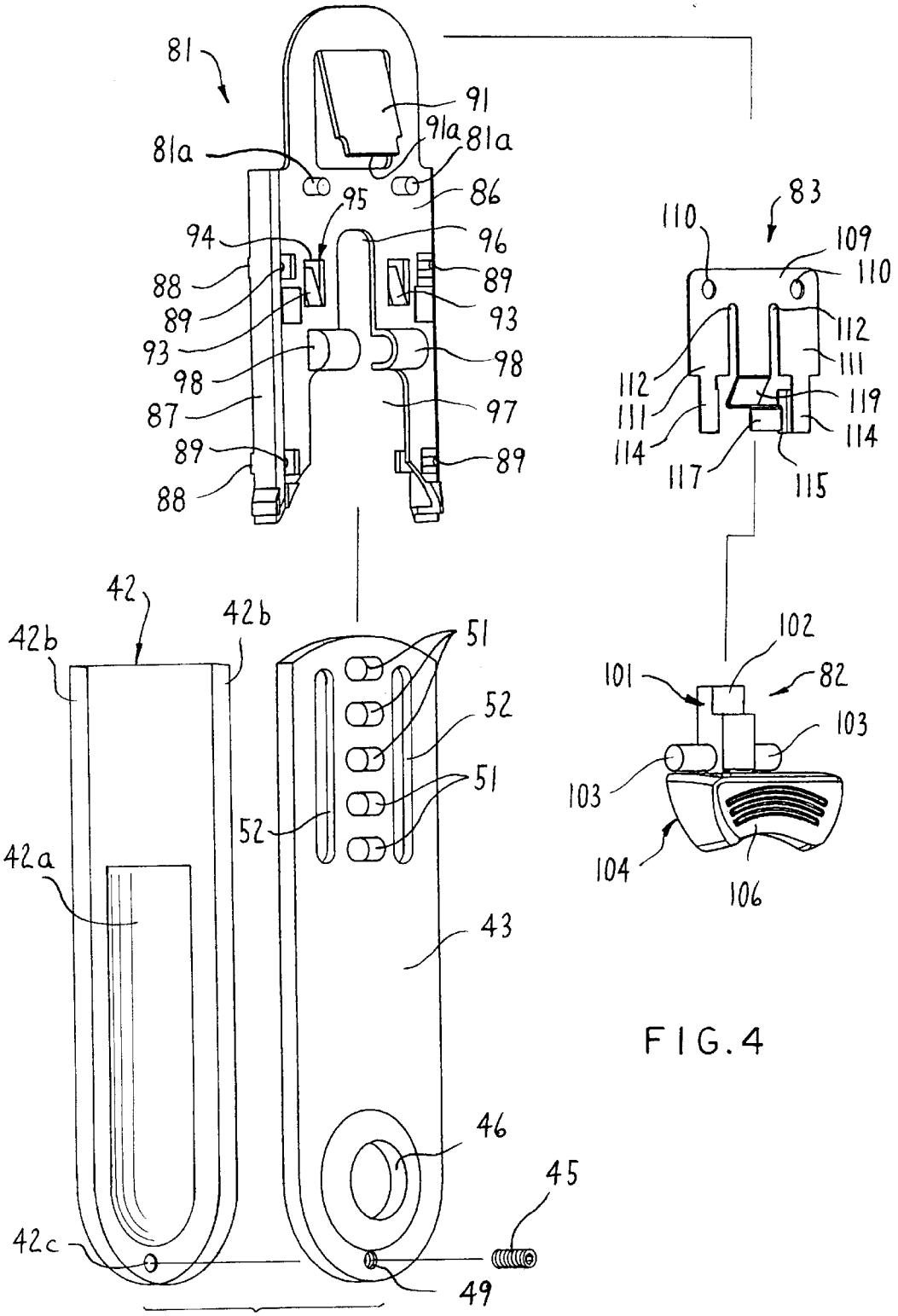
FIG. 4 an exploded perspective view of the upright and the component parts of a height-adjustment mechanism.
Figure 6:
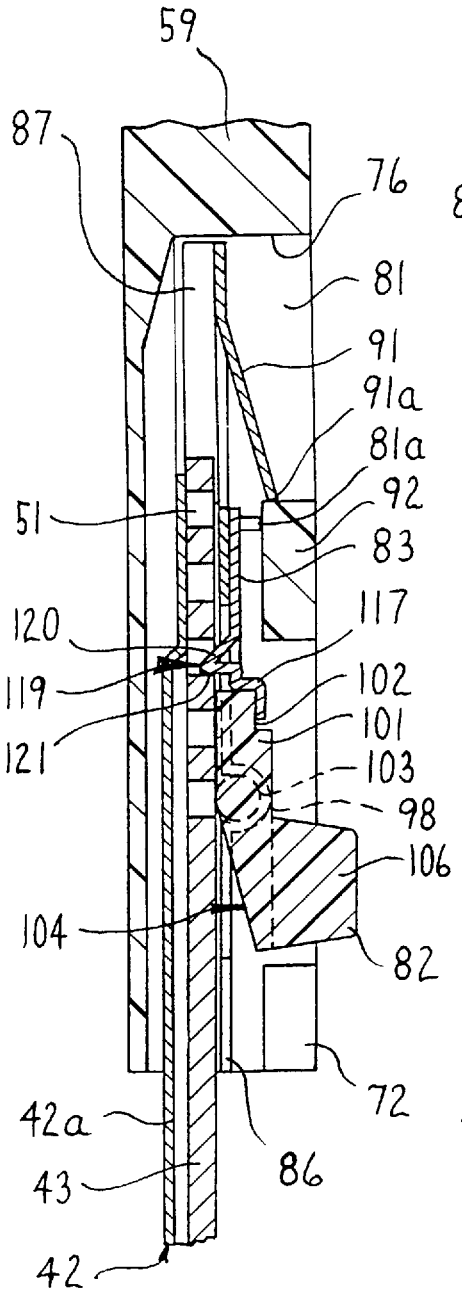
FIG. 6 is a partial side elevational view in cross-section as viewed in the direction of arrows 6—6 in FIG. 5.
Figure 8:
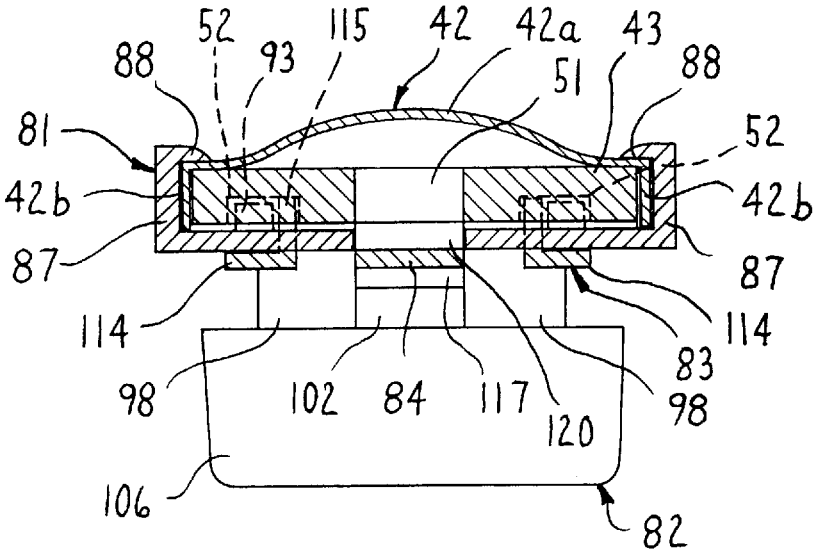
FIG. 8 is a top cross-sectional view as viewed in the direction of arrows 8—8 of FIG. 5.

Referring to FIGS. 4, 6 and 8, the outer cover 42 is preferably formed of a nylon material and includes a back wall 42*a* which has a rearwardly curved shape. A pair of side walls 42*b* extend forwardly from the back wall 42*a* such that the cover slips over the upright 43 as seen in FIG. 8. The back wall 42*a* also includes a threaded bore 42*c* which receives a set screw 45 therein. The cover 42 is fastened to the upright 43 by the set screw 45 which is screwed into the screw hole 50 of the upright 43 and the bore 42*c* of the cover 42.

Figure 5:
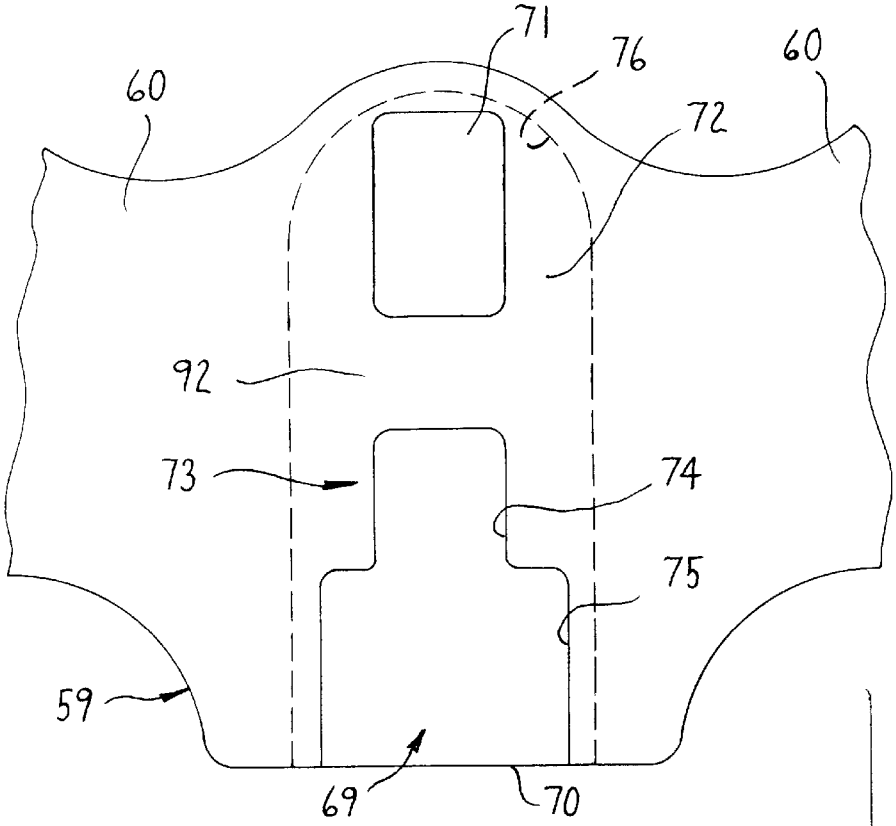
FIG. 5 is a partial exploded front view illustrating the height-adjustment mechanism mounted to the upright prior to insertion into a pocket formed in a chair back.
Figure 5:
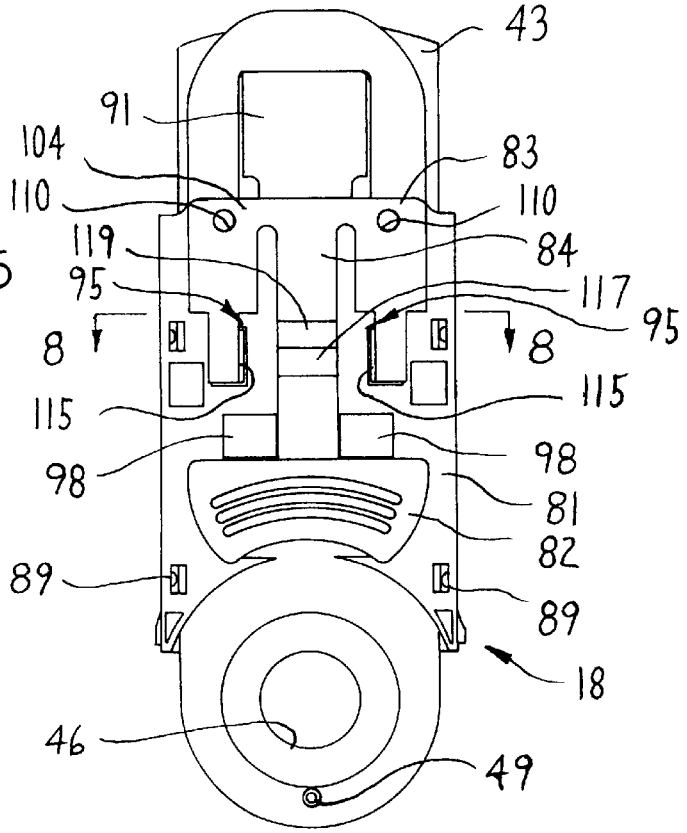

As generally seen in FIG. 5, the back frame 40 is slidably connected to the upper end of the upright 43 by the height-adjustment mechanism 18. As a result, the height-adjustment mechanism 18 allows adjustment of the height of the back frame 40 relative to the seat assembly 11.

More particularly, the back frame 40 has a ring-like shape which defines an open area 58. The back frame 40 includes a vertically extending lower support column 59 which extends vertically upwardly from the upright 43. The back frame 40 also includes lower frame sections 60 which project sidewardly from the opposite sides of the lower hub, side frame sections 61 which project upwardly from the lower frame sections 60 and define the opposite side edges of the back frame 40, and a top frame section 62 which extends horizontally between the upper ends of the upright frame sections 61 and defines the top edge of the back frame 40. Further, the lower frame sections 60 extends forwardly away from the lower support column 59 so as to define an access space 63 (FIG. 1) in front of the lower support column 59 for accessing the height-adjustment mechanism 18.

To support the back of a user, the back frame 40 has a plastic inner shell 63 which is fixedly mounted on the front side thereof and includes a resiliently flexible membrane covering the central open area 58. The plastic inner shell 63 is covered by a cushion 66 which conforms to the contours of a user.

The access space 63 thereby is formed between the front side of the lower support column 59 and the back side of the inner shell 64 and is accessible from the back of the chair 10 so as to allow an occupant to insert their hand forwardly and downwardly therein.

The particular construction of the seat and back assemblies 11 and 12 and in particular, of the inner shell 64 and the back frame 40, is disclosed in U.S. patent application Ser. No. 08/846,616, entitled MEMBRANE CHAIR, filed Apr. 30, 1997 (Atty. Ref.: Haworth Case 215). The disclosure of this latter application, in its entirety, is incorporated herein by reference.

To mount the back frame 40 to the upright 43, the lower support column 59 includes an interior pocket or compartment 69 (FIG. 5) which is adapted to receive the height-adjustment mechanism 18 therein. The pocket 69 extends upwardly into the lower support column 59 and has an open lower end 70. To secure the height-adjustment mechanism 18 therein, the pocket 69 is formed with a window 71 in the front pocket wall 72 which opens forwardly therethrough and is located near the upper end of the pocket 69.

The front wall 72 also includes a notched area 73 near the lower end 70 of the pocket 69 to permit actuation of the height-adjustment mechanism 18 when it is secured within the pocket 69. The notched area 73 includes a narrow upper section 74 and a wider lower section 75, the function of which will be discussed in more detail hereinafter. Other than the window 71 and the notched area 73, the pocket 69 otherwise is defined by an interior surface 76.

As seen in FIGS. 4–8, the height-adjustment mechanism 18 comprises three parts, namely a molded plastic housing 81, an actuator lever 82 which is pivotally connected to the housing 81, and a cover plate 83 which is mounted to the housing 81 and includes a resilient spring leg 84. The housing 81, actuator lever 82 and cover plate 83 are assembled together to define a self-contained unit or cartridge which is snapped as a unit into the back frame 40 and is slidably connected to the upright 43 to permit vertical movement of the back frame 40 relative to the seat assembly 11. The height-adjustment mechanism 18 normally prevents downward movement of the back frame 40 but can be disengaged by manually pressing the actuator lever 82 to lower the back frame 40.

The housing 81 is formed as a one-piece plastic part which is defined by a front wall 86 and spaced apart left and right side walls 87 which project rearwardly from the opposite side edges of the front wall 86. The front wall 86 and side walls 87 essentially have a C-shaped cross-section when viewed from above as seen in FIG. 8.

The side walls 87 are laterally spaced apart so as to receive the upright 43 therebetween. The inside surface of each of the side walls 87 includes a pair of vertically spaced ribs 89 thereon. The ribs 89 slide along the opposing side walls 42b of the cover 42 which is mounted to the upright 43 and reduces friction therebetween during vertical sliding of the housing 81. The material of the cover, which preferably is nylon, is selected so as to further reduce friction during sliding of the housing 81.

To slidably secure the housing 81 to the upright 43, the rear edges of the side walls 87 further include inwardly projecting tabs 88 which extend behind the back wall 42*a* of the cover 42. While the side walls 87 are laterally spaced apart so as to receive the upright 43 therebetween, the tabs 88 are spaced rearwardly from the front wall 86 so as to accommodate the thickness of the upright 43. As a result, the front wall 86, side walls 87 and inwardly projecting tabs 88 effectively define a vertically elongate slot or channel which opens downwardly so as to slidably receive the upper end of the upright 43 therein.

Figure 7:
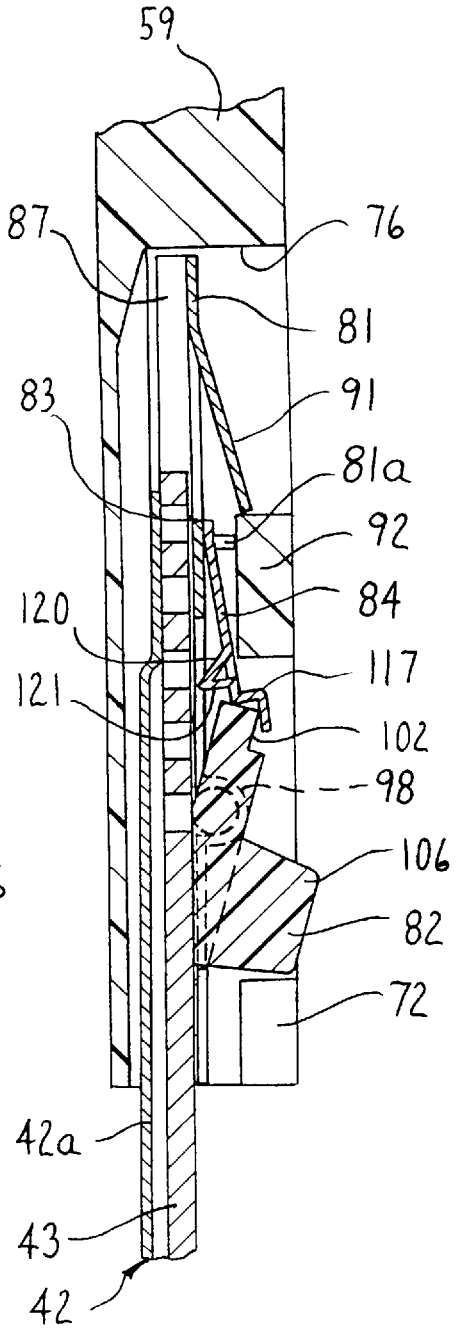
FIG. 7 is a partial side elevational view in cross-section illustrating the height-adjustment mechanism of FIG. 6 in a disengaged condition.

The width and thickness of the housing 81 also is dimensioned so as to be slidable into the lower open end 70 of the pocket 69. To secure the housing 81 in the pocket 69, the upper end of the housing 81 includes a cantilevered locking plate 91 which projects downwardly and forwardly. As the housing 81 is slid into the pocket 69, the locking plate 91 is deflected by the solid section 92 (FIGS. 5 and 6) of the front wall 72 located just below the window 71. The housing 81 is then slid further into the pocket 69 until the locking plate 91 snaps into the window 71. In particular as seen in FIGS. 6 and 7, the locking plate 91 returns to the undeflected condition such that the lower edge 91*a* thereof abuts against the lower edge of the window 71 and prevents downward sliding of the housing 81 relative to the back frame 40. In effect, the locking plate 91 snap-lockingly engages the housing 81 to the back frame 40.

The housing 81 also includes a pair of rearwardly projecting cantilevered stop flanges 93 which project rearwardly and upwardly from the housing front wall 86. The stop flanges 93 are spaced inwardly from the opposite housing side walls 87 so as to be slidably received within the respective slots 52 of the upright 43. As the housing 81 is slid downwardly onto the upright 43, the stop flanges 93 deflect until they are aligned with the slots 52, at which time they return to their undeflected position. Since the stop flanges 93 project upwardly, they permit downward sliding of the housing 81 but abut against the upper ends of the slots 52 to define an upper limit for the vertical travel of the housing 81 along the upright 43. The stop flanges 93 prevent the housing 81 from being inadvertently disengaged from the upright 43 during upward sliding thereof, although they can be manually deflected by appropriate tools to remove the height-adjustment mechanism 18 from the upright 43.

The housing 81 also includes rectangular openings 94 from which the stop flanges 93 project. To secure the cover plate 83 to the housing 81, the openings 94 are wider than the width of the stop flanges 93 to define vertically elongate spaces 95 formed on the inner side the stop flanges 93 as will be described in more detail hereinafter. The housing 81 also includes a pair of outwardly projecting bosses 81*a* which have a tip that is located closely adjacent to the solid wall section 92.

To permit engagement of the spring leg 84 of the cover plate 83 with the apertures 51 of the upright 43, the front wall of the housing 81 includes a vertically elongate slot or opening comprising an upper slot section 96 and a lower slot section 97. The upper slot section 96 is located between the pair of stop flanges 93, and opens downwardly into the lower slot section 97 which accommodates the actuator lever 82.

To pivotally connect the actuator lever 82 to the housing 81, a pair of pin seats 98 are formed in the housing 81 on the opposite sides of the upper slot section 96. In particular, the housing front wall 86 is formed with the pin seats 98 on the opposite left and right sides of the upper slot section 96. The pin seats 98 project forwardly from the front wall 86, and are open on two sides for pivoting engagement of the actuator lever 82 therewith. In particular, each pin seat 98 is open on a rear side thereof to permit the actuator lever 82 to be pivotally inserted therein, and are open on an interior side thereof to allow the actuator lever 82 to be disposed between the pin seats 98 within the upper slot section 96.

More particularly with respect to the actuator lever 82, the actuator lever 82 is formed as a one-piece plastic part which is pivotally supported on the housing 81. The actuator lever 82 includes a vertically elongate upper leg 101 which projects upwardly toward the spring leg 84. The uppermost end of the upper leg 101 includes a notch or stepped section 102 which thereby has a reduced thickness at the upper extremity thereof relative to the thickness of the remainder of the upper leg 101.

The actuator lever 82 also includes a pair of pivot pins 103 which are formed integral with the upper leg 101 and project sidewardly therefrom. The pivot pins 103 are adapted to be slidably received within the pin seats 98 of the housing 81. In particular, the pivot pins 103 are pivotally engaged with the pin seats 98 through the open rear side thereof.

The actuator lever 82 further includes a lower leg 104 which is formed integral with and extends downwardly from the upper leg 101. The lower leg 104, however, when viewed from the side as seen in FIGS. 6 and 7 also projects forwardly at an angle relative to the upper leg 101.

While the upper leg 101 normally is positioned closely against the upright 43, the lower leg 104 projects forwardly away from the upright 43. Thus, when the lower leg 104 is pressed rearwardly toward the upright 43, the upper leg 101 pivots forwardly away from the upright 43 in response thereto.

To assist in the actuation of the lower leg 104, an enlarged finger pad 106 is formed integral with the lower leg 104. To operate the actuator lever 82, the finger pad 106 is accessible in the access space 63 (FIG. 1) defined between the back frame 40 and the inner shell 64 attached thereto. Thus, a user can access and manually actuate the actuator lever 82 by inserting their hand downwardly into the space 63 and then pressing the finger pad 106 rearwardly. This effects a pivoting movement of the upper leg 101 which moves the spring leg 84 outwardly as described in more detail hereinafter.

The cover plate 83 is a metal plate preferably formed of a spring steel or other suitable resilient material. The cover plate 83 mounts to the front side of the housing 81 in facing relation therewith so that the spring leg 84 thereof can engage the apertures 51 of the upright 43 for locking the height-adjustment mechanism 18 at a selected height.

More particularly, an upper section 109 of the cover plate 83 is formed with a pair of openings 110. When the cover plate 83 is mounted to the housing 81, the bosses 81*a* of the housing 81 project forwardly through the openings 110 so as to permit secure engagement of the cover plate 83 with the housing 82 to prevent relative vertical movement therebetween. When the height-adjustment mechanism 18 is seated in the pocket 69, the solid wall section 92 located close to the tips of the bosses 81*a* prevent the cover plate 83 from sliding off of the bosses 81*a*.

Further, the lower section of the cover plate 83 is divided into three separate sections which extend downwardly from the upper plate section 109. These three sections include left and right locking legs 111 as well as the spring leg 84 which is located therebetween. The spring leg 84 is separated from the extensions 111 located on the opposite sides thereof by vertically elongate slots 112.

The lowermost ends of the extensions 111 terminate at lower locking legs 114 which are provided for securing the cover plate 83 to the housing 81. In particular, each lower locking leg 114 includes a rearwardly projecting locator tab or flange 115. The locator tab 115 has a generally rectangular shape and projects rearwardly so as to be inserted into the respective space 95 in the housing 81 which is formed directly adjacent to the stop flanges 93 thereof. As seen in FIG. 8, the locator tabs 115 are inserted rearwardly through the spaces 95 in relatively tight-fitting engagement therewith so as to locate the cover plate 83 relative to the housing 81 and prevent upward and downward slippage of the cover plate 83.

The spring leg 84 is formed integral to the upper plate section 109 in cantilevered relation therewith. The spring leg 84 projects downwardly away from the plate section 109 and terminates at a stepped end 117. The stepped end 117 is bent so as to have a generally Z-shape which projects forwardly and then downwardly. The stepped end 117 rests on the notched section 102 of the actuator lever 82.

During pivoting of the actuator lever 82, the notched section 102 serves to lift the spring leg 84 away from the upright 43. Since the spring leg 84 is resiliently deflectable, pivoting of the actuator lever 82 is permitted and once the actuator lever 82 is released, the spring leg 84 functions to bias the upper leg 101 back towards the upright 43.

To engage the height-adjustment mechanism 18 with the upright 43, the spring leg 84 is bent to not only form the stepped end 117 but also form a catch or projection 119 which projects rearwardly from the spring leg 84. The catch 119 is adapted to project into one of the apertures 51 of the upright 43 as seen in FIG. 6.

More particularly as seen in FIGS. 6 and 7, the rear surface of the catch 119 defines an inclined camming surface 120 which is slidable along the upright 43, and the lower edge of the catch 119 defines a stop surface 121. The camming surface 120 serves to deflect the spring leg 84 outwardly so as to permit upward sliding of the height-adjustment mechanism 18 along the upright 43.

However, the stop surface 121 faces downwardly so as to project into and rest upon a lower edge of the aperture 51 to thereby prevent downward sliding of the height-adjustment mechanism 18 relative to the upright 43. As a result, the catch 119 supports the back rest 40 at a selected height depending upon which one of the apertures 51 the catch 119 is engaged with.

In use, the height-adjustment mechanism 18 is assembled by seating the pivot pins 103 of the actuator lever 82 into the pin seats 98 formed in the housing 81. Thereafter, the cover plate 83 is mounted to the housing 81 by first inserting the locking plate 91 of the housing 81 through the rectangular opening 110 of the cover plate 83. Then, the lower end of the cover plate 83 is moved toward the housing 81 to insert the locator tabs 115 of the lower locking legs 114 into engagement with the corresponding side spaces 95 of the housing 91 which are located adjacent to the flanges 93. Thus, the height-adjustment mechanism 18 can be formed as a separate independent unit or cartridge.

To connect the back frame 40 to the upright 43, the height-adjustment mechanism 18 is inserted into the frame pocket 69. In particular, the height-adjustment mechanism 18 is inserted upwardly into the pocket 69 until the cantilevered locking plate 91 of the housing 81 engages with the window 71. While the locking plate 91 prevents disengagement of the height-adjustment mechanism 18 from the back frame 40, a user can manually press the locking plate 91 inwardly to remove the height-adjustment mechanism 18 therefrom.

Thereafter, the back frame 40 is slid onto the top end of the upright 43. In particular, the upright 43 is slidably received within the slot or channel formed by the housing 81. The housing 81 slides downwardly onto the upright 43 until the stop flanges 93 snap into the vertical slots 52 formed in the upright 43. These stop flanges 93 permit vertical sliding of the housing 81 relative to the upright 43 but contact the top end of the slots 52 to define the upper limit of travel.

Preferably, however, the tabs 115 extend through the spaces 95 into slidable engagement with the slots 52 so as to serve the same stopping function as the stop flanges 93. Thus, while the spaces 95 are provided in the housing 81, the stop flanges preferably are eliminated. Accordingly, the housing 81, cover plate 83 and actuator 82 are assembled onto the upright 43 and then the back frame 40 is mounted thereon.

When the housing 81 is engaged with the upright 43, the catch 119 is biased by the spring leg 84 into a selected one of the upright apertures 51. The downward facing stop surface 121 thereof prevents downward movement of the back frame 40 once it is engaged with an aperture 51. The camming surface 120 of the catch 119, however, lifts the spring leg 84 out of engagement with the apertures 51 as the back frame 40 is raised. Thus, the spring leg 84 acts in a ratchet-like manner as it moves upwardly along the upright 43.

To lower the back frame 40, a user manually presses the actuator lever 82 so as to lift the spring leg 84 to the disengaged position (FIG. 7) which thereby permits downward sliding of the back frame 40. With this arrangement, the height of the back assembly 12 can be readily moved relative to the seat assembly 11 to a selected one of the heights defined by the vertically spaced apertures 51.

Further, only a minimum number of component parts are required for the height-adjustment mechanism 18, namely the housing 81, actuator lever 82 and cover plate 83. The spring leg 84 of the cover plate 83 serves the dual function of defining a stop surface for setting the height of the back assembly 12 while at the same time serving as a biasing means for returning the actuator button to its normal position.

Figure 9:
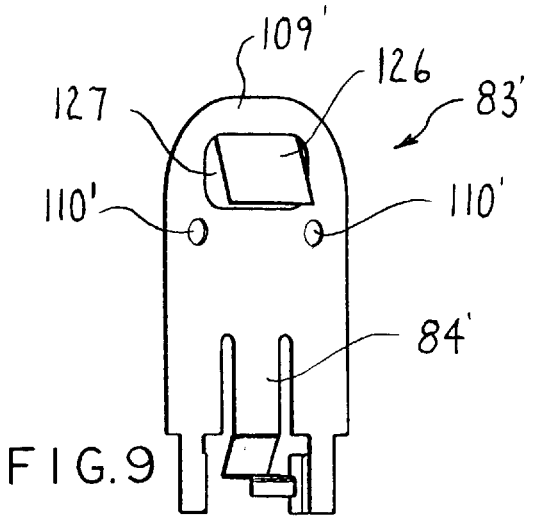
FIG. 9 is a perspective view illustrating a second embodiment of a spring plate of the height-adjustment mechanism.

In an alternative arrangement illustrated in FIG. 9, a cover plate designated as 83' preferably is used to provide a stronger connection between the back frame 40 and the height-adjustment mechanism 18. In particular, the cover plate 83' is formed substantially the same as the cover plate 83 except that the upper section 109' thereof is vertically enlarged and includes a downwardly projecting cantilevered locking plate 126. The locking plate 126 is structurally and functionally the same as the above-described locking plate 91. In particular, the locking plate 126 deflects as the height-adjustment mechanism 18 is inserted into the pocket 69 but then snaps into the window 71 formed therein. Since the locking plate 126 is formed of a spring steel, a stronger connection is provided than that provided by the plastic locking plate 91.

Therefore, when the cover plate 83' is used, the locking plate 91 preferably is eliminated from the housing 81. However, since the locking plate 126 preferably is punched from the cover plate 83' and an opening 127 is formed thereby, the locking plate 126 may be used in combination with the locking plate 91. In particular, the locking plate 91 would project through the opening 127 and abut against the inside face of the locking plate 126 such that both locking plates 91 and 126 engage the window 71.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A chair comprising:

a seat assembly mounted on a base:

a vertically elongate upright which is connected to a rear section of said seat assembly and extends upwardly from said rear section;

a back assembly having an upwardly extending frame which includes a pocket therein which opens downwardly toward said upright; and a height-adjustment assembly which is slidably received in said pocket of said back assembly, said height-adjustment assembly including a housing adapted to be slidably connected to said upright, and engagement means connected to said housing for releasably engaging said height-adjustment assembly with said upright to support said back assembly at a selected height relative to said seat assembly, said height-adjustment assembly including securing means connected to said housing for removably securing said height-adjustment assembly in said pocket in response to sliding of said height-adjustment assembly therein, said securing means defining a connection between said height-adjustment assembly and said back assembly which is free of separate independent fasteners.

2. A chair according to claim 1, wherein said securing means defines a snap fit connection between said height-adjustment assembly and said back assembly.

3. A chair according to claim 1, wherein said securing means comprises a projection which projects outwardly away from said housing, said projection being deflectable inwardly to permit sliding of said height-adjustment assembly into said pocket, said projection extending into an opening in said pocket for said securing of said height-adjustment assembly therein.

4. A chair according to claim 1, wherein said housing defines a downward opening slot in which said upright is slidably received, said engagement means comprising a movable projection which extends into said slot for releasable engagement with said upright.

5. A chair according to claim 4, wherein said engagement means comprises a plate which includes a cantilevered spring leg having said projection thereon, said spring leg biasing said projection into engagement with said upright in said slot to prevent downward movement of said height-adjustment assembly, said projection being slidable upwardly along said upright.

6. A chair according to claim 5, wherein said height-adjustment assembly has an actuator which is pivotally mounted thereon and includes an end section connected to said spring leg, said actuator being manually actuatable to deflect said spring leg outwardly and disengage said projection from said upright to permit downward sliding of said back assembly.

7. A chair according to claim 1, wherein said upright includes a plurality of vertically spaced openings and said engagement means includes a projection projecting inwardly into a selected one of said openings to prevent downward sliding of said height-adjustment assembly, said projections being slidable upwardly along said upright to a selected one of said apertures in response to movement of said back assembly upwardly.

8. A chair comprising:

a seat assembly mounted on a base:

a vertically elongate upright which is connected to a rear section of said seat assembly, said upright including a plurality of vertically spaced openings;

a back assembly; and a height-adjustment assembly which is connected to said back assembly and includes a housing, a spring plate and an actuator;

said housing defining a downward opening slot which receives an upper end of said upright therein, said housing having a side wall defining one side of said slot;

said spring plate including a plate-like mounting section facing towards said side wall which has at least one mounting part formed integral therewith, said mounting part projecting rearwardly into engagement with said side wall of said housing to mount said spring plate thereon, said spring plate including an elongate resilient leg formed integral with said mounting section, said resilient leg including a catch formed integrally therewith which projects through said side wall into said slot, said catch being biased into engagement with a selected one of said apertures in said upright to prevent downward movement of said back assembly, said projection being movable out of engagement with said apertures in response to upward movement of said back assembly so as to be slidable upwardly along said upright; and said actuator having a movable end section engaged with said spring leg such that said spring leg resists movement of said actuator, said actuator being movable to deflect said spring leg outwardly and move said catch out of engagement with said apertures to permit downward movement of said back assembly.

9. A chair according to claim 8, wherein said back assembly includes a downwardly opening pocket, at least one of said housing and said spring plate including securing means for removably securing said height-adjustment assembly in said pocket, said securing means being free of separate independent fasteners and being engaged with said pocket in response to sliding of said height-adjustment assembly therein.

10. A chair according to claim 9, wherein said securing means comprises a cantilevered flange projecting outwardly and downwardly, said flange being deflectable to permit sliding of said height-adjustment assembly into said pocket, said flange projecting into an opening in said pocket so as to abut against a lower edge of said opening when said height-adjustment mechanism is seated in said pocket.

11. A chair according to claim 10, wherein said flange is formed integral with said mounting section of said spring plate.

12. A chair according to claim 8, wherein said catch has a downward facing stop surface which abuts against a lower edge of said one of said aperture in said upright to prevent downward movement of said back assembly, said catch including a generally upward facing inclined surface which deflects said spring leg outwardly to push said catch out of said aperture during upward sliding of said back assembly.

13. A chair according to claim 8, wherein said spring plate is formed of a resilient spring steel.

14. A height-adjustment assembly for slidably supporting a back assembly to a seat assembly of a chair comprising:

a housing which defines a downward opening slot therein, a front wall defining a front side of said slot, and bearing parts disposed on said front wall;

a spring plate which includes a plate-like mounting section having at least one mounting part formed integral therewith, said mounting part projecting rearwardly into engagement with said front wall of said housing to mount said spring plate on said housing, said spring plate including an elongate resilient leg formed integral with said mounting part which includes a catch thereon, said catch projecting through said front wall into said slot; and an actuator lever having pivot means for pivotally engaging said actuator lever to said bearing parts so as to be pivotable about a pivot axis, said actuator lever including an end section connected to said spring leg such that said spring leg resists pivoting of said actuator lever, said actuator lever deflecting said spring leg during pivoting thereof to move said projection out of said slot.

15. A height-adjustment assembly according to claim 14, wherein said housing, said spring plate and said actuator lever are formed as separate one-piece components which are connected together without the use of separate independent fasteners.

16. A height-adjustment assembly according to claim 15, wherein at least one of said housing and said spring plate includes a cantilevered flange which extends downwardly and outwardly away from said front wall for mounting said height-adjustment assembly to the back assembly.

17. A height-adjustment assembly according to claim 16, wherein said housing includes at least one cantilevered stop which extends upwardly into said slot for slidably mounting said height-adjustment assembly on an upright of the seat assembly.

18. A height-adjustment assembly according to claim 14, wherein said catch on said spring leg is defined by a cantilevered tab projecting inwardly into said slot, said tab projecting downwardly so that a lower edge thereof defines a stop surface and an inner side thereof defines an inclined camming surface for deflecting said spring leg outwardly.

19. A height-adjustment assembly according to claim 14, wherein said catch on said spring leg is defined by a bent section of said spring leg which has an inclined section defining a camming surface and a substantially horizontal section defining a stop surface for said catch.

20. A height-adjustment assembly according to claim 14, wherein said pivot means comprises pivot pin sections extending sidewardly from said actuator lever, each of said bearing parts opening sidewardly toward the other of said bearing parts and opening rearwardly into said slot, said pin sections of said actuator lever being slidably received in said bearing parts through said open rear sides thereof.

* * * * *